US010948269B2

(12) United States Patent
Norris

(10) Patent No.: US 10,948,269 B2
(45) Date of Patent: Mar. 16, 2021

(54) PERIMETER SECURITY SYSTEM WITH NON-LETHAL DETAINMENT RESPONSE

(71) Applicant: Wrap Technologies, Inc., Las Vegas, NV (US)

(72) Inventor: Elwood Norris, Poway, CA (US)

(73) Assignee: Wrap Technologies Inc., Tempe, AZ (US)

( * ) Notice: Subject to any disclaimer, the term of this patent is extended or adjusted under 35 U.S.C. 154(b) by 0 days.

(21) Appl. No.: 16/702,136

(22) Filed: Dec. 3, 2019

(65) Prior Publication Data

US 2020/0191532 A1 Jun. 18, 2020

Related U.S. Application Data

(60) Provisional application No. 62/775,158, filed on Dec. 4, 2018.

(51) Int. Cl.

| | |
|---|---|
| ***F41H 13/00*** | (2006.01) |
| ***F42B 12/68*** | (2006.01) |
| ***F42B 12/66*** | (2006.01) |

(52) U.S. Cl.

CPC ..... *F41H 13/0006* (2013.01); *F42B 12/66* (2013.01); *F42B 12/68* (2013.01)

(58) Field of Classification Search

CPC ..... F41H 13/0006; F42B 12/66; F42B 12/68

USPC ..... 89/1.34; 102/504

See application file for complete search history.

(56) References Cited

U.S. PATENT DOCUMENTS

| | | | |
|---|---|---|---|
| 34,626 | A | 3/1862 | Ely |
| 34,628 | A | 3/1862 | Gault |
| 35,734 | A | 6/1862 | Gault |
| 39,282 | A | 7/1863 | Ganster |
| 271,825 | A | 2/1883 | Fiske |
| 347,988 | A | 8/1886 | Boyd |
| 1,070,582 | A | 8/1913 | Browning |
| 1,151,070 | A | 8/1915 | Victory |
| 1,198,035 | A | 9/1916 | Huntington |
| 1,211,001 | A | 1/1917 | Steinmetz |
| 1,217,415 | A | 2/1917 | Colomyjczuk |
| 1,229,421 | A | 6/1917 | Downs |
| 1,276,689 | A | 8/1918 | Poudrier |
| 1,304,857 | A | 5/1919 | Davis |
| 1,343,747 | A | 6/1920 | Radakovich |
| 1,488,182 | A | 3/1924 | Whelton |
| 1,536,164 | A | 5/1925 | Tainton |
| 2,354,451 | A | 7/1944 | Forbes |
| 2,372,383 | A | 3/1945 | Lee |
| 2,373,363 | A | 4/1945 | Wellcome |

(Continued)

FOREIGN PATENT DOCUMENTS

| | | | |
|---|---|---|---|
| CA | 2162221 | A1 | 5/1996 |
| GB | 2386673 | A | 9/2003 |
| JP | 2011/106748 | A | 6/2011 |

*Primary Examiner* — Bret Hayes

(74) *Attorney, Agent, or Firm* — Jason Jones

(57) ABSTRACT

A method is provided of remotely detaining a subject with a temporary restraint. The method includes monitoring at least a portion of a perimeter of an area, and receiving an event signal generated as a result of remote movement or presence of a subject. A projectile is be remotely launched from a launcher a toward the subject, the projectile including a pair of pellets and a tether connecting the pellets. The projectile is capable of at least temporarily detaining the subject when wrapped about the subject.

16 Claims, 4 Drawing Sheets

(56) References Cited

U.S. PATENT DOCUMENTS 2,373,364 A 4/1945 Wellcome
2,455,784 A 12/1948 Lapsensohn
2,611,340 A 9/1952 Manning
2,668,499 A 2/1954 Mourlaque
2,797,924 A 7/1957 Stewart
3,085,510 A 4/1963 Campbell
3,340,642 A 9/1967 Vasiljevic
3,484,665 A 12/1969 Mountjoy et al.
3,583,087 A 6/1971 Huebner
3,717,348 A 2/1973 Bowers
3,773,026 A 11/1973 Romero
3,803,463 A 4/1974 Cover
3,831,306 A 8/1974 Gregg
3,921,614 A 11/1975 Fogelgren
4,027,418 A 6/1977 Baldi et al.
4,166,619 A 9/1979 Bergmann et al.
4,193,386 A 3/1980 Rossi
4,253,132 A 2/1981 Cover
4,318,389 A 3/1982 Kiss, Jr.
4,466,417 A 8/1984 Mulot et al.
4,559,737 A 12/1985 Washington
4,656,947 A 4/1987 Gordon et al.
4,664,034 A 5/1987 Christian
4,750,692 A 6/1988 Howard
4,752,539 A 6/1988 Vatter
4,912,867 A 4/1990 Dukes, Jr.
4,912,869 A 4/1990 Govett
4,947,764 A * 8/1990 Rohr ..... F41H 13/0006 109/11
4,962,747 A 10/1990 Biller
5,003,886 A 4/1991 Pahnke et al.
5,078,117 A 1/1992 Cover
5,103,366 A 4/1992 Battochi
5,145,187 A 9/1992 Lewis
5,279,482 A 1/1994 Dzenitis et al.
5,314,196 A 5/1994 Ruelle
5,315,932 A 5/1994 Bertram
5,326,101 A 7/1994 Fay
5,372,118 A 12/1994 Schmidt, III et al.
5,396,830 A 3/1995 Kornblith et al.
5,460,155 A 10/1995 Hobbs, II
5,561,263 A 10/1996 Baillod
5,649,466 A 7/1997 Genovese
5,654,867 A 8/1997 Murray
5,698,815 A 12/1997 Ragner
5,706,795 A 1/1998 Gerwig
5,750,918 A 5/1998 Mangolds et al.
5,782,002 A 7/1998 Reed
5,786,546 A 7/1998 Simson
5,814,753 A 9/1998 Rieger
5,831,199 A 11/1998 McNulty, Jr. et al.
5,898,125 A 4/1999 Mangolds et al.
5,904,132 A 5/1999 Biller
5,943,806 A 8/1999 Underwood
5,962,806 A 10/1999 Coakley et al.
5,996,504 A 12/1999 Lowery
6,219,959 B1 * 4/2001 Hsieh ..... E05G 5/02 109/3
6,283,037 B1 9/2001 Sclafani
6,381,894 B1 5/2002 Murphy
6,382,071 B1 5/2002 Bertani
6,543,173 B1 4/2003 Golan
6,575,073 B2 6/2003 McNulty, Jr. et al.
6,615,622 B2 9/2003 MacAleese et al.
6,636,412 B2 10/2003 Smith
6,729,222 B2 5/2004 McNulty, Jr.
6,820,560 B1 11/2004 Romppanen
6,880,466 B2 4/2005 Carman
6,898,887 B1 5/2005 Stratbucker
7,042,696 B2 5/2006 Smith et al.
7,065,915 B2 6/2006 Chang
7,075,770 B1 7/2006 Smith
7,114,450 B1 10/2006 Chang
7,143,539 B2 12/2006 Cerovic et al.
7,218,501 B2 5/2007 Keely
7,237,352 B2 7/2007 Keely et al.
7,314,007 B2 1/2008 Su
7,327,549 B2 2/2008 Smith et al.
D570,948 S 6/2008 Cerovic et al.
7,412,975 B2 8/2008 Dillon, Jr.
7,444,939 B2 11/2008 McNulty et al.
7,444,940 B2 11/2008 Kapeles et al.
D602,109 S 10/2009 Cerovic et al.
7,640,839 B2 1/2010 McNulty, Jr.
7,640,860 B1 1/2010 Glover et al.
7,673,411 B1 3/2010 Baldwin
7,686,002 B2 3/2010 Andrews
7,778,005 B2 8/2010 Saliga
7,791,858 B2 9/2010 Hummel et al.
7,856,929 B2 12/2010 Gavin et al.
7,859,818 B2 12/2010 Kroll et al.
7,900,388 B2 3/2011 Brundula et al.
7,905,180 B2 3/2011 Chen
7,950,176 B1 5/2011 Nemtyshkin et al.
7,950,329 B1 5/2011 Nemtyshkin et al.
7,966,763 B1 6/2011 Schneider et al.
7,984,676 B1 7/2011 Gavin et al.
8,015,905 B2 9/2011 Park
8,024,889 B2 9/2011 Bunker
8,082,199 B2 12/2011 Kwok
D651,679 S 1/2012 Klug et al.
8,141,493 B1 3/2012 Kuchman
8,186,276 B1 5/2012 Olden et al.
8,231,474 B2 7/2012 Stethem
8,245,617 B2 8/2012 Martinez et al.
8,261,666 B2 9/2012 Garg
8,281,776 B2 10/2012 Körver et al.
8,336,777 B1 12/2012 Pantuso et al.
8,339,763 B2 12/2012 McNulty, Jr.
8,441,771 B2 5/2013 Hinz et al.
8,547,679 B2 10/2013 Gavin
8,561,516 B2 10/2013 Martinez et al.
8,601,928 B2 12/2013 Martinez et al.
8,671,841 B2 3/2014 Raquin et al.
8,695,578 B2 4/2014 Olden et al.
8,677,675 B2 5/2014 Koch
8,757,039 B2 6/2014 Martinez et al.
8,857,305 B1 10/2014 Tseng
8,881,654 B2 11/2014 Seecamp
8,896,982 B2 11/2014 Beechey et al.
8,899,139 B2 12/2014 Brill et al.
9,025,304 B2 5/2015 Brundula et al.
D736,885 S 8/2015 Swan et al.
9,134,099 B2 9/2015 Tseng
9,157,694 B1 10/2015 Tseng
9,220,246 B1 12/2015 Roman
9,255,765 B2 2/2016 Nelson
9,303,942 B2 4/2016 Sievers
9,335,119 B2 5/2016 Werner
9,414,578 B2 8/2016 Thornbrough
9,581,417 B2 2/2017 Tseng
9,638,498 B2 5/2017 Chang
D791,901 S 7/2017 Swan et al.
10,107,599 B2 10/2018 Norris et al.
2002/0134365 A1 9/2002 Gray
2002/0170418 A1 11/2002 McNulty, Jr. et al.
2003/0106415 A1 6/2003 Smith
2003/0165041 A1 9/2003 Stethem
2003/0165042 A1 9/2003 Stethem
2004/0245338 A1 12/2004 Poloniewicz
2005/0166441 A1 8/2005 Mattox
2006/0112574 A1 6/2006 Hodge et al.
2006/0120009 A1 6/2006 Chudy, II
2006/0254108 A1 11/2006 Park
2007/0019358 A1 1/2007 Kroll
2007/0101893 A1 5/2007 Shalev et al.
2007/0264079 A1 11/2007 Martinez et al.
2009/0084284 A1 4/2009 Martinez et al.
2010/0126483 A1 5/2010 Makowski
2010/0315756 A1 12/2010 Gavin
2011/0005373 A1 1/2011 Martinez et al.
2011/0271825 A1 11/2011 Howland
2012/0019975 A1 1/2012 Hanchett et al.
2012/0170167 A1 7/2012 Beechey et al.

(56) References Cited

U.S. PATENT DOCUMENTS

| | | | | |
|---|---|---|---|---|
| 2012/0210904 | A1 | 8/2012 | Merems | |
| 2014/0216290 | A1* | 8/2014 | Yee | F42B 15/00 102/374 |
| 2014/0331984 | A1 | 11/2014 | Brahler, II et al. | |
| 2014/0334058 | A1 | 11/2014 | Galvan et al. | |
| 2015/0075073 | A1 | 3/2015 | Sylvester | |
| 2015/0168107 | A1 | 6/2015 | Tseng | |
| 2015/0241180 | A1 | 8/2015 | Pruett | |
| 2015/0276351 | A1 | 10/2015 | Pekarek et al. | |
| 2015/0316345 | A1 | 11/2015 | Brahler, II et al. | |
| 2016/0010949 | A1 | 1/2016 | Teetzel et al. | |
| 2016/0161225 | A1 | 6/2016 | Searle et al. | |
| 2016/0238350 | A1 | 8/2016 | Tseng | |
| 2017/0029816 | A1 | 2/2017 | Swiderski | |
| 2017/0160060 | A1 | 6/2017 | Purvis | |
| 2017/0241751 | A1 | 8/2017 | Nerheim | |
| 2017/0276461 | A1 | 9/2017 | Norris et al. | |
| 2018/0003462 | A1 | 1/2018 | Chavez | |
| 2018/0094908 | A1* | 4/2018 | Down | F41H 13/0006 |
| 2018/0292172 | A1 | 10/2018 | Ehrlich | |
| 2018/0335779 | A1* | 11/2018 | Fisher | F41H 13/0006 |

* cited by examiner

PERIMETER SECURITY SYSTEM WITH NON-LETHAL DETAINMENT RESPONSE

PRIORITY CLAIM

Priority is claimed of and to U.S. Provisional Patent Application Ser. No. 62/775,158, filed Dec. 4, 2018, which is hereby incorporated herein by reference in its entirety.

BACKGROUND OF THE INVENTION

Field of the Invention

The present invention relates generally to non-lethal, near-range weapons systems to aid in temporarily detaining, immobilizing, impeding or subduing hostile or fleeing subjects.

Related Art

It has been recognized for some time that police and military personnel can benefit from the use of weapons and devices other than firearms to deal with some hostile situations. While firearms are necessary tools in law enforcement, they provide a level of force that is sometimes unwarranted. In many cases, law enforcement personnel may wish to deal with a situation without resorting to use of a firearm. It is generally accepted, however, that engaging in hand-to-hand combat is not a desirable alternative.

For these and other reasons, non-lethal, generally near-range devices for detaining subjects have been used with some success. Examples of such devices are described in U.S. Pat. No. 10,107,599, to the present inventor. While these devices, and devices like these, have proven effective, they have to date been restricted to usage where law enforcement or other personnel are near the subject of interest. As such, effective, non-lethal solutions for remotely engaging subjects continue to be sought.

SUMMARY OF THE INVENTION

In accordance with one aspect of the invention, a method is provided of remotely detaining a subject with a temporary restraint. The method can include monitoring a perimeter of an area; and receiving an event signal generated by remote movement or presence of a subject. A projectile can be remotely launched from a launcher toward the subject. The projectile can include a pair of pellets and a tether connecting the pellets. The projectile can be capable of at least temporarily detaining the subject when wrapped about the subject.

In accordance with another aspect of the technology, a system is provided of remotely detaining a subject with a temporary restraint. The detaining system can include a sensor system operable to monitor a perimeter of an area. An event signal generator can be operable to generate an event signal if movement or presence of a subject is detected by the sensor system. A launcher can be operable to remotely launch a projectile toward the subject. The projectile can include a pair of pellets and a tether connecting the pellets. The projectile can be capable of at least temporarily detaining the subject when wrapped about the subject.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
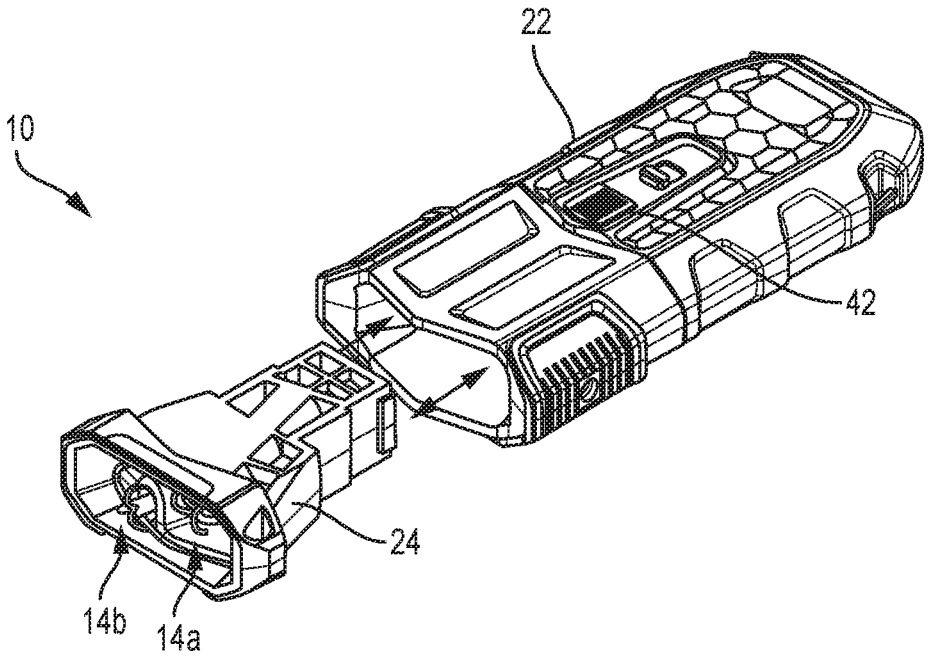
FIG. 1 is a top perspective view of a hand-held, near-range launcher in accordance with an aspect of the present invention, shown in an exploded condition with a projectile casing being removed the device.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a camera" can include one or more of such cameras, if the context dictates.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present technology relates generally to non-lethal, near-range weapons systems that can be effectively used as an aid in impeding the progress of or detaining aggressive or fleeing subjects. Devices in accordance with the present technology can be advantageously used to temporarily impede a subject's ability to stand, walk, run, or use his or her arms. These options can be beneficial in cases where law enforcement, security personnel or military personnel wish to detain a subject, but do not wish to use lethal or harmful force or to engage in close proximity, hand-to-hand combat.

Figure 2:
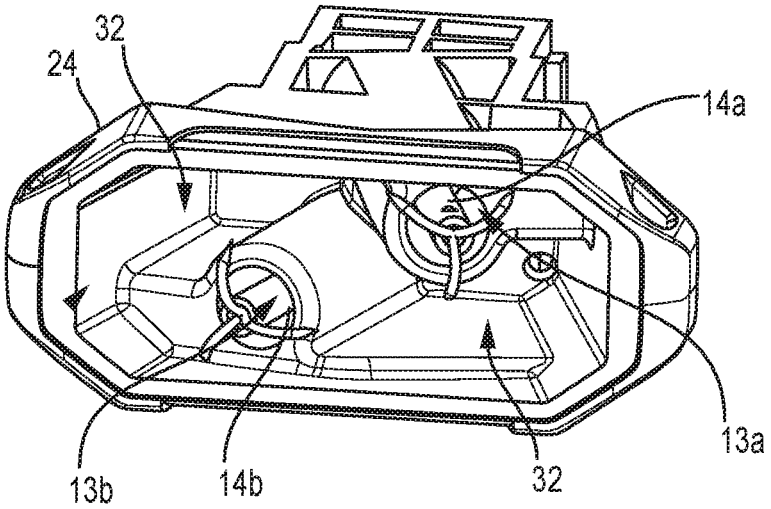
FIG. 2 is a front view of the projectile casing of FIG. 1.
Figure 3:
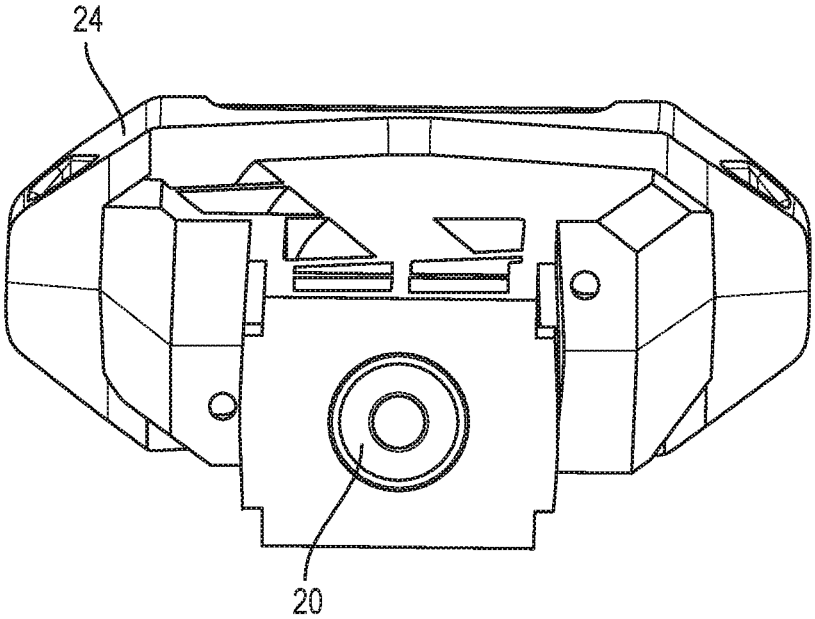
FIG. 3 is a rear view of the projectile casing of FIG. 1.

FIGS. 1 through 3 illustrate one exemplary launcher 10 that can be used in accordance with the present technology. This launcher is used to expel an entangling projectile toward a subject: after contacting the subject, the entangling projectile wraps about arms or legs of the subject to temporarily restrain or subdue the subject. The launcher 10 is similar in operation and design as those disclosed in patents and patent applications to the present inventor, such as U.S. Pat. No. 10,036,615, U.S. patent application Ser. No. 15/399,537 and U.S. patent application Ser. No. 15/467,958, all of which are hereby incorporated herein by reference in their entirety. Reference is made to these patents and publications for additional information about the launcher shown in FIGS. 1 through 3.

In the example shown, launcher 10 generally includes an entangling projectile (12 in FIG. 4) that includes a pair of pellets 14*a*, 14*b*, and a tether (16 in FIG. 4) connecting the pellets. A projectile casing 24 can be provided that can include a pair of sockets 13*a*, 13*b* (see FIG. 3). Each socket can be sized and shaped to carry one of the pair of pellets: in the examples shown, socket 13*a* carries pellet 14*a* and socket 13*b* carries pellet 14*b*.

The projectile casing 24 can include a selectively activatable power source or pressure source 20 (FIG. 3). The pressure source can be capable of expelling the entangling projectile from the projectile casing toward a subject. The system can also include a launcher body 22 that can carry a control system (not shown in detail) that can be operable to activate the pressure source to expel the entangling projectile from the projectile casing toward the subject.

While not so required, the projectile casing 24 can be removably engageable with the launcher body 22 to allow removal of the projectile casing from the launcher after expulsion of the entangling projectile from the projectile casing. In the example shown, launcher 10 includes a user input interface, or in this case a trigger 42, that is in communication with the control system. The control system is in turn in communication with the power or pressure source (20 in FIG. 3). Generally, activation of the user input, or trigger, causes the control system to activate the pressure or power source, which results in expulsion of the entangling projectile from the projectile casing 22.

In the example shown, once the projectile has been deployed from a particular projectile casing, that casing can be removed and a fresh projectile casing with a preinstalled entangling projectile and pressure or power source can be installed within the launcher. Activation of a first casing and replacement with a fresh casing can be achieved in a matter of seconds. Thus, law enforcement, security, military, etc., personnel can very rapidly exchange a spent projectile casing with a fresh projectile casing that is loaded and ready to activate by the launcher.

FIG. 2 illustrates a front view of the casing 44. In this view, pellets 14*a*, 14*b* can be seen stored, ready for use, in sockets 13*a*, 13*b*, respectively. Tether storage compartments 32 can be provided and can consist of shaped depressions formed in the projectile casing to allow the tether (16 in FIG. 4) to be stored adjacent the pellets prior to use.

In the example shown in FIGS. 1-3, the power or pressure source 20 comprises a cartridge blank. This type of pressure source is well known to contain gunpowder that is typically activated by striking a primer formed in the cartridge. The blank cartridge contains no slug: deployment of the cartridge results only in a high-pressure wave being directed from the projectile casing. This high-pressure wave is utilized by the present technology to propel the entangling projectile from the system at high velocity. In one embodiment of the invention, the cartridge blank can be irremovably attached to the cartridge such that the cartridge is a single actuation cartridge. In this manner, installation of the cartridge can be done in a controlled manufacturing environment, to ensure the proper cartridge is used, that the cartridge is properly installed, and that the casing 24 is otherwise ready for use. The cartridge can be secured to the casing by adhesive, mechanical crimp, etc.

Figure 4:
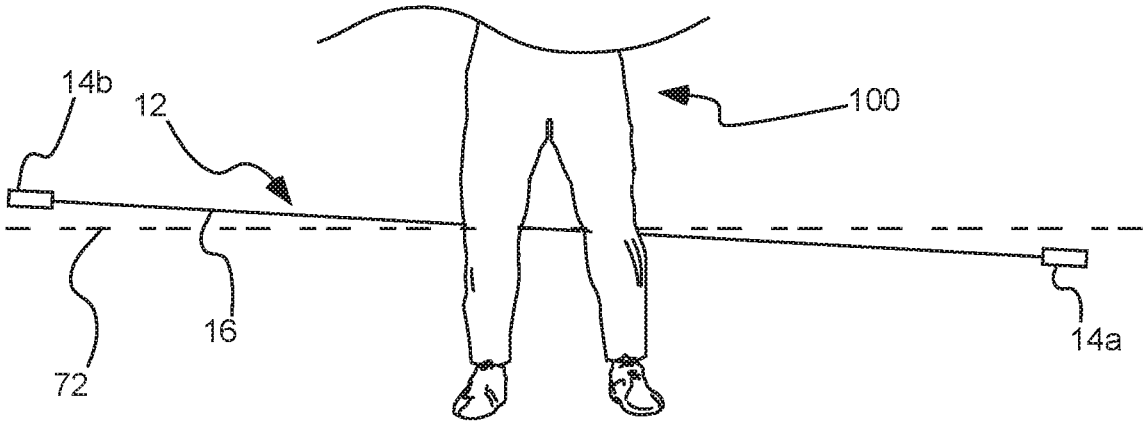
FIG. 4 is a front view of a portion of a subject in accordance with an embodiment of the invention, shown immediately prior to an entangling projectile engaging the subject's legs.

Operation of the entangling projectile is shown generally in FIG. 4: after being released by a launcher, the projectile 12 travels toward a subject 100. As the projectile travels toward the subject, pellets 14 travel away from one another, resulting in the tether 16 being pulled substantially taught between the two. Once the projectile engages the subject (in the example shown the subject's legs are engaged), the pellets and tether wrap about the subject and thereby temporarily entangle and/or disable the subject.

A variety of differing pellet and tether combinations can be utilized in the present technology. In the examples shown in FIG. 4, the projectile 12 is shown with two generic pellets 14 connected by a single tether 16. While more than two pellets can be utilized, the examples shown herein include only two. In some embodiments, the invention is limited to two, and only two, pellets connected by a single tether. In one aspect, the invention consists of two pellets and a single tether. In one aspect, the invention consists essentially of two pellets and a single tether. It has been found that limiting the number of pellets to two results in a more effective deployment system: the risk of tangling of the tether 16 is diminished and the pellets spread apart from one another much more cleanly and quickly after being deployed from the launcher. This results in a more consistent trajectory after deployment. This arrangement can also allow, with the proper launcher configuration, the projectiles to be more accurately directed toward a subject.

Figure 5:
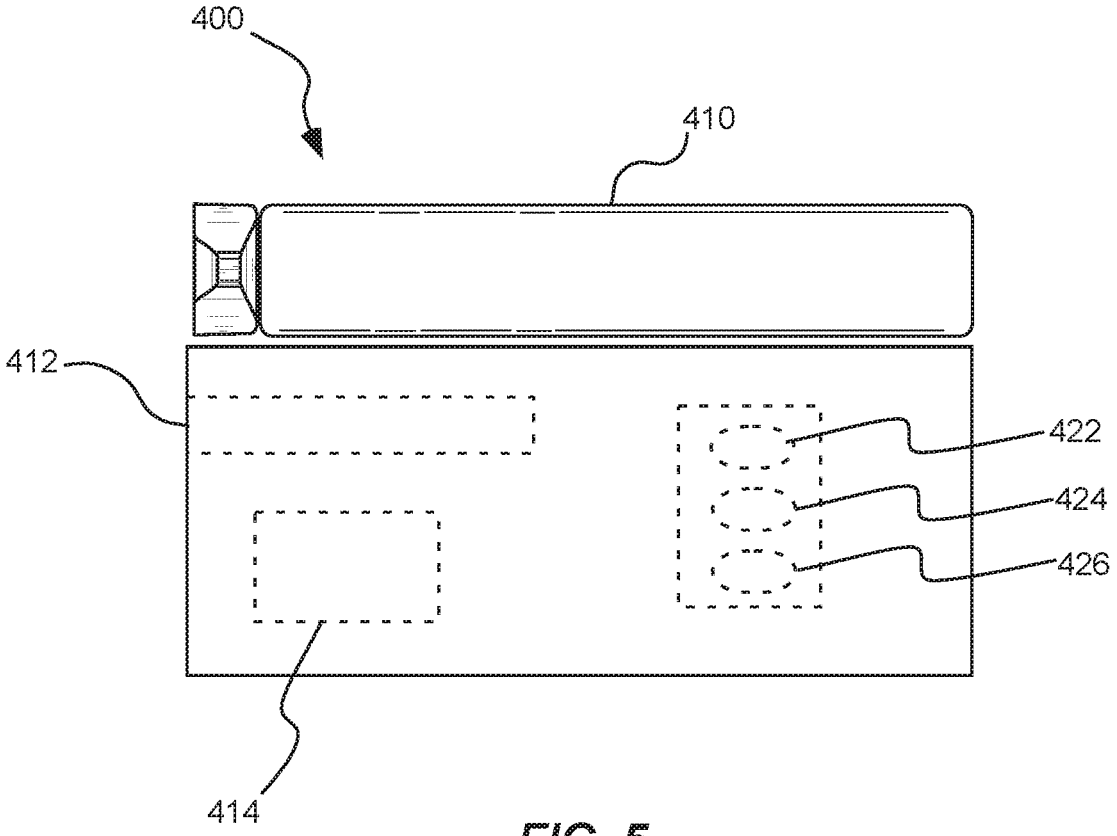
FIG. 5 is a side, schematic view of a stationary launcher assembly in accordance with an aspect of the invention.

The launcher shown in FIGS. 1-3 is generally intended for use as a hand-held launcher, to be wielded similarly to a pistol. While such devices have proven very successful in near-range engagement with subjects, the present technology provides solutions that can be used remotely. For example, turning now to FIGS. 5 and 6, in one aspect of the invention, a stationary launcher assembly 400 is shown that can be used in a remote monitoring system. The launcher assembly can be configured to be mounted upon a suitable stand, or upon other structure, as a stand-alone, remote unit. The launcher assembly can include, without limitation, a launcher 410 that can include, as described and shown in more detail in connection with FIGS. 1 through 3, a projectile that can include a pair of pellets and a tether connecting the pellets. As above, the projectile can be capable of at least temporarily detaining the subject when wrapped about the subject.

In addition to the launcher 410, the assembly 400 can also include a sensor system 412 that can be operable to monitor a perimeter of an area. The sensor system can include one or more sensors operable to detect the presence or movement of a subject. Suitable examples include, without limitation, common motion-detecting devices such as passive infrared sensors, microwave detectors, area reflective detectors, ultrasonic detectors, vibration detectors, etc. The sensor system can also include video cameras and the like that can provide images to a remote processing center. The images can be either analyzed by a computing system to detect the presence of a subject, or by human personnel. The image data can be viewed in real-time and/or saved for later access. The sensor system can also include range-finding sensors that can determine a distance and orientation of a subject relative to the launcher.

The sensor system 412 is generally operable to detect when a subject is present and can initiate the generation of an event signal indicating the presence of a subject. An event signal generator 414 is also provided that can be operable to generate an event signal in response to detection of a subject by the sensor system. Once the event signal has been generated, a signal can be provided to the launcher 410 to remotely launch a projectile toward the subject.

The launcher 410 can be stationary or mounted on a moveable platform such that it can be positioned remotely. This can be accomplished either manually or automatically to target or track a subject within the target area such that the projectile can more precisely engage a subject. A variety of suitable systems can be used to aim the launcher and can be controlled remotely by a computer system and/or a human operator.

Figure 6:
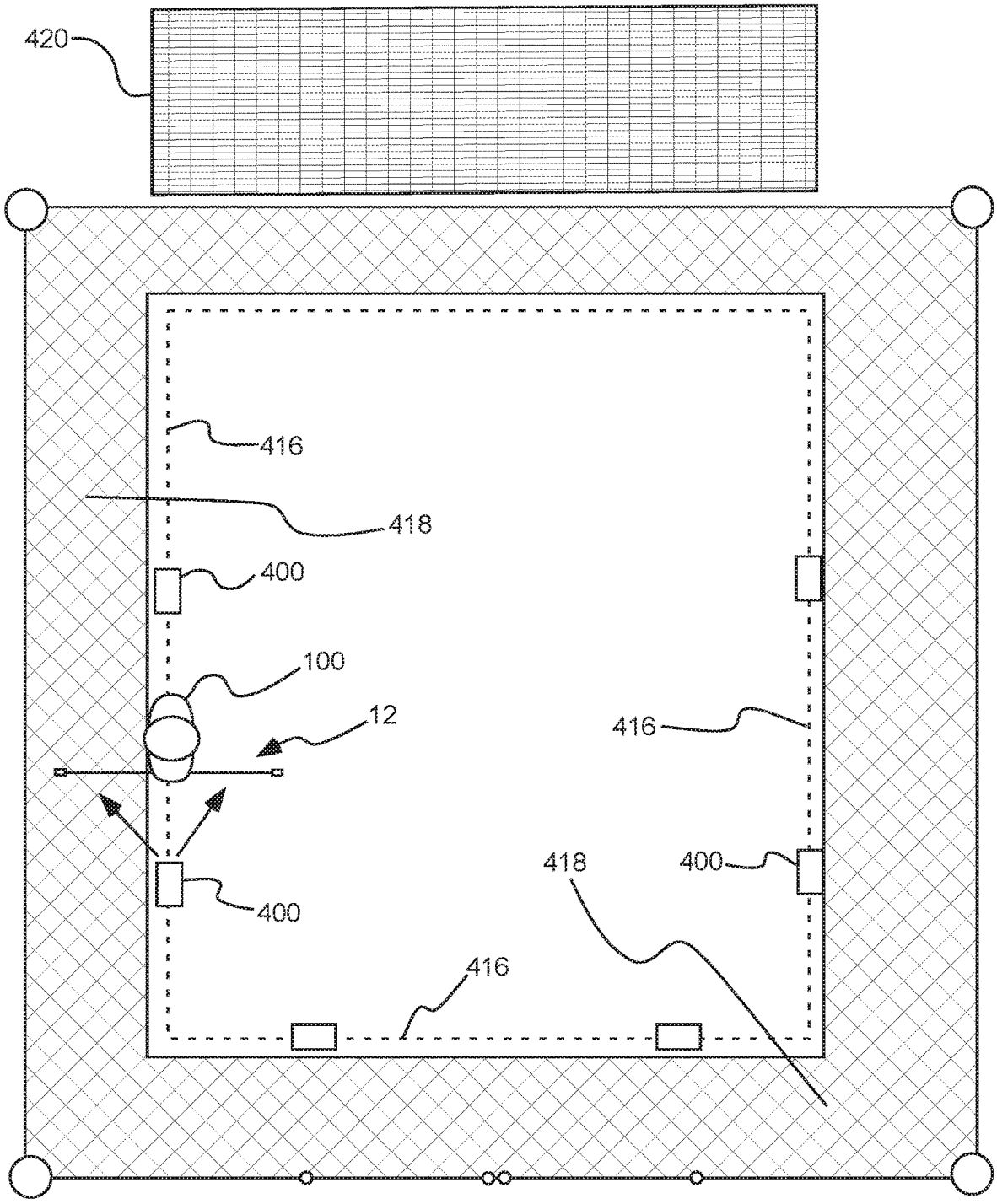
FIG. 6 is a top view of an area having a perimeter monitored in accordance with the present technology.

FIG. 6 illustrates a system for monitoring a perimeter of an area in accordance with one example of the present technology. Note that FIG. 6 is not drawn to scale—this figure is provided for explanatory purposes, and may not represent actual spatial relationships of the components shown. The dashed line 416 generally represents a perimeter that is to be monitored. Such a perimeter might be established, for example, around a yard within which it is desired to retain incarcerated personnel. In the event such a person (e.g., subject 100) approaches too near an outer fence track 418, the present system can be used to temporarily detain the subject until personnel in authority can be deployed to retain the subject. Such authority might, for example, be housed in structure or command center 420 and can be readily deployed to reach the detained subject prior to the subject disentangling him- or herself from the projectile.

As will be appreciated, by positioning multiple launcher assemblies 400 about the perimeter 416, the entire perimeter can be monitored. Note that the device shown in FIG. 5 includes only a single sensor system 412 (oriented to the left of that page). Where appropriate, each assembly can include two or more sensors, event signal generators 414, launchers 410, etc., oriented in a variety of directions. In the example shown in FIG. 6, any location that the subject 100 can "break" the perimeter is monitored by one or more assemblies 400.

The embodiment illustrated in FIG. 6 is but one example of a manner in which a perimeter can be monitored using the present system. Similar arrangements can be used to prevent entry into a restricted area, or, for example, to prevent passage along a single pathway or entry/exit from a hallway, doorway, etc.

The present technology thus provides a system by which a subject can be temporarily detained, providing personnel in authority ample time to reach the subject prior to the subject clearing him- or herself from the projectile. The projectile causes no injury to the subject in the vast majority of cases but nonetheless prevents the subject from moving freely. As such, it is an ideal manner by which subjects can be remotely monitored and detained so as to temporarily restrict them from entering or leaving restricted areas.

The system can be fully automated. In one embodiment, the assembly 400 can include, in addition to the sensor system 412 and the signal generator 414, a sending or transmitting unit 422 that can broadcast the event signal to an appropriate location. Identifying data 424 can be stored or associated with the assembly so that the event signal can allow responding personnel to locate the device (and thus, the subject recently entangled by the device). A receiving unit 426 can also be carried by the assembly to allow the assembly to receive signals. The unit can thus be actuated remotely to command the device to launch a projectile upon receiving a manual signal from an operator. This embodiment can be effective when the sensor 412 provides video data to a remote operator.

The assembly 400 can be powered in a number of manners. Each assembly shown can be hardwired to a power source, or a battery power source can be provided. The units lend themselves well to solar power, as a solar panel can easily be mounted atop the launcher 410 to charge the assembly when not in use.

The various sensors, cameras, signal generators, range finders, transmitters, etc., can be selected from a number of known devices. One of ordinary skill in the art, having possession of this disclosure, can readily appreciate the operation and function of such components, as well as the necessary circuitry, power supplies, etc., that can be utilized to incorporate such technology into the present systems.

In addition to the apparatus described above, the present technology also provides a method of remotely detaining a subject with a temporary restraint. The method can include monitoring at least a portion of a perimeter of an area and receiving an event signal generated as a result of remote movement or presence of a subject. A projectile can be remotely launched from a launcher toward the subject. The projectile can include a pair of pellets and a tether connecting the pellets. The projectile can be capable of at least temporarily detaining the subject when wrapped about the subject.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

The invention claimed is:

1. A method of remotely monitoring a perimeter of an area and detaining a subject at the perimeter with a temporary restraint, comprising:

monitoring at least a portion of a perimeter of an area;

receiving an event signal generated as a result of remote movement or presence of a subject at the perimeter of the area; and remotely launching from at least one of a plurality of launchers positioned at the perimeter of the area a projectile toward the subject, the projectile including a pair of pellets and a tether connecting the pellets, the projectile being capable of at least temporarily detaining the subject when wrapped about the subject.

2. The method of claim 1, wherein the event signal is generated by a motion sensor.

3. The method of claim 1, wherein monitoring utilizes a video surveillance system.

4. The method of claim 3, wherein the event signal is generated manually by personnel based on the video surveillance.

5. The method of claim 1, further comprising transmitting an alert of the launch to a command center.

6. The method of claim 1, further comprising transmitting identifying data associated with the at least one of the plurality of launchers, the identifying data including at least a location of the launcher along the perimeter of the area.

7. The method of claim 6, further comprising dispatching personnel to a location of the at least one launcher on the perimeter of the area.

8. A system of remotely detaining a subject with a temporary restraint, comprising:

a sensor system operable to monitor a perimeter of an area;

an event signal generator operable to generate an event signal if movement or presence of a subject is detected by the sensor system at the perimeter of the area; and a plurality of launchers positioned along the perimeter of the area, each of the plurality of launchers carrying a projectile, each of the plurality of launchers being operable to remotely launch a respective projectile toward the subject as the subject crosses the perimeter, each of the projectiles including a pair of pellets and a tether connecting the pellets, each of the projectiles being capable of at least temporarily detaining the subject when wrapped about the subject.

9. The system of claim 8, wherein the sensor system includes a motion sensor.

10. The system of claim 8, wherein the sensor system includes a video surveillance system.

11. The system of claim 10, wherein the launcher is activated manually by personnel based on the video surveillance.

12. The system of claim 8, further comprising a transmitter operable to transmit an alert of the launch to a command center.

13. The system of claim 8, further comprising identifying data associated with the launcher, the identifying data including at least a location of the launcher along the perimeter of the area.

14. The system of claim 13, further comprising personnel being dispatchable to a location of the launch.

15. A method of remotely monitoring a perimeter of an area and detaining a subject at the perimeter with a temporary restraint, comprising:

monitoring at least a portion of a perimeter of an area;

receiving an event signal generated as a result of remote movement or presence of a subject at the perimeter of the area;

remotely launching from at least one of a plurality of launchers positioned at the perimeter of the area a projectile toward the subject, the projectile including a pair of pellets and a tether connecting the pellets, the projectile being capable of at least temporarily detaining the subject when wrapped about the subject;

transmitting identifying data associated with the at least one of the plurality of launchers, the identifying data including at least a location of the launcher along the perimeter of the area; and dispatching personnel to the location of the launch along the perimeter of the area.

16. The method of claim 15, wherein at least two of the plurality of launchers are oriented toward one another along the perimeter.

* * * * *